United States Patent [19]

Auer et al.

[11] Patent Number: 4,936,809

[45] Date of Patent: Jun. 26, 1990

[54] SOUND-PRODUCING TOY HAVING DEFORMABLE BODY

[75] Inventors: Robert T. Auer, East Stroudsburg, Pa.; Richard J. Mayer, Parsippany, N.J.

[73] Assignee: Buddy L Corporation, New York, N.Y.

[21] Appl. No.: 404,625

[22] Filed: Sep. 8, 1989

[51] Int. Cl.[5] ..... A63H 5/00

[52] U.S. Cl. ..... 446/184; 446/409; 446/183; 446/192; 446/207; 446/218

[58] Field of Search ..... 446/183, 184, 188, 207, 446/176, 213, 218, 417, 470, 224, 196, 195, 193, 194, 409, 192, 216

[56] References Cited

U.S. PATENT DOCUMENTS

| | | | |
|---|---|---|---|
| 677,113 | 6/1901 | Bruce | 446/193 |
| 2,606,399 | 8/1952 | Graham | 446/184 X |
| 4,560,392 | 12/1985 | Basevi | 446/224 X |
| 4,678,451 | 7/1987 | Ventura | 446/471 |
| 4,832,651 | 5/1989 | Buck | 446/224 |

*Primary Examiner*—Robert A. Hafer

*Assistant Examiner*—BethAnne Cicconi

*Attorney, Agent, or Firm*—Michael Ebert

[57] ABSTRACT

A sound-producing toy having a hollow body formed of resilient material, whereby when the body is depressed and deformed by a player, this action produces a honking sound. The body envelops an air-filled cavity at one end of which is an air-intake valve whose actuating element is outside the body so that when the element is actuated by the player, air is admitted into the cavity. Also disposed in the cavity is a sound producer having an air outlet normally closed by a membrane which is partially secured to the outlet so that when the body is depressed by the player, the resultant increase in internal air pressure above ambient is exerted against the membrane and causes deflection thereof to permit air to escape from the outlet. The escaping air causes the membrane to vibrate to produce a honking sound. The air expelled through the outlet creates a partial vacuum in the internal cavity which acts to maintain the body in its deformed state. But when the player operates the actuating element of the air-intake valve, air is admitted into the cavity and the body resumes its normal state.

6 Claims, 2 Drawing Sheets

Fig. 1.
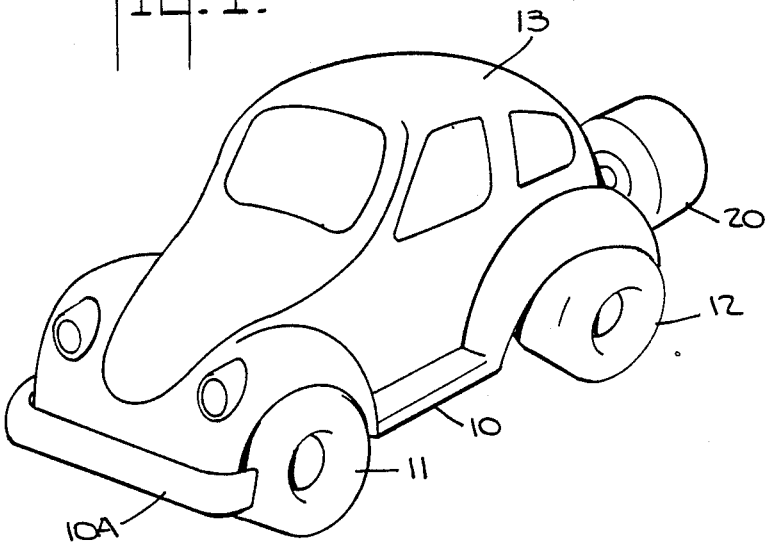
Fig. 3.
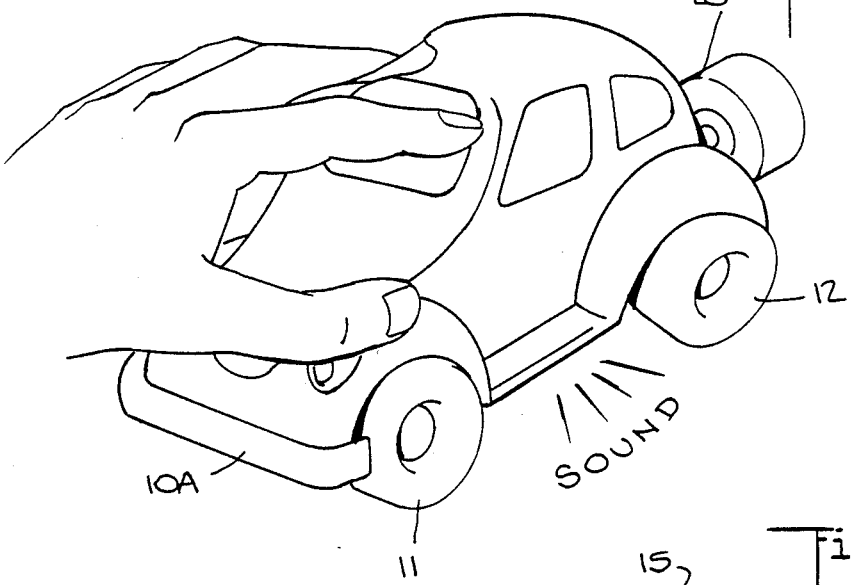
Fig. 7.
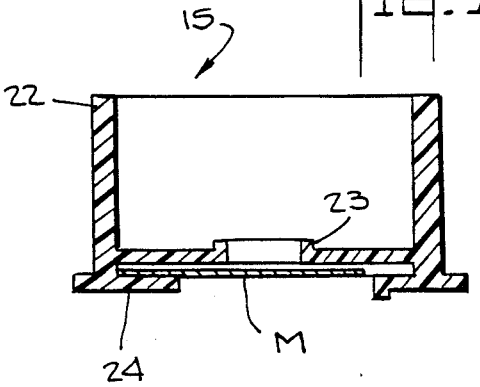
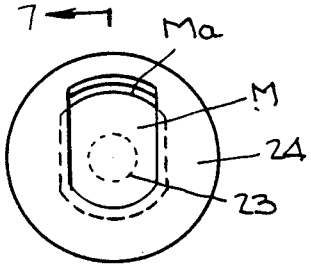
Fig. 6.

SOUND-PRODUCING TOY HAVING DEFORMABLE BODY

BACKGROUND OF INVENTION

1. Field of Invention

This invention relates generally to sound-producing toys having a deformable hollow body, and more particularly to a toy vehicle for pre-school children having a hollow body formed of resilient material which when pressed in and deformed produces a honking sound, the body resuming its normal state when the player operates an actuating element.

2. Status of Prior Art

Toy vehicles for pre-school children which have no motor and are therefore hand propelled are well known. Such toy vehicles have limited play possibilities, for there is little a child can do with this toy other than push it back and forth on a playing surface. Play activity sometimes takes a destructive tack, for the typical child not only enjoys operating a toy in its intended manner, but he also delights in wrecking the toy, particularly when he loses interest in its play possibilities.

In the case of a conventional hand-propelled toy made of rigid plastic material, metal or wood, the temptation to try to break the toy is encouraged by the fact that the normal play possibilities of the toy are quickly exhausted. And the nature of the materials from which the toys are made is such that the child may well succeed in ruining the toy by crashing it against a hard surface.

It is known to provide a toy vehicle whose body is partially formed of resilient plastic material. Thus the Kennedy et al., U.S. Pat. No. 4,588,386, discloses a motorized toy car whose body has a front hood section of resilient material which is deformable to simulate the effects of a car crash. The front section can be caused to resume its normal state, but a relatively elaborate mechanism is required for this purpose.

While the invention will be described in a toy vehicle embodiment, it is to be understood that it is applicable to other hollow, deformable forms, such as toy animals and figures.

SUMMARY OF INVENTION

In view of the foregoing, the main object of this invention is to provide a sound-producing toy such as a vehicle for pre-school children having a hollow body formed of resilient material which when pressed in and deformed by a player retains its deformed state until an actuating element is operated by the player.

More particularly, an object of this invention is to provide a toy of the above type which when pressed in and deformed by the player generates, in the case where the toy is in the form of a vehicle, a honking sound simulating that of an automobile horn, and in the case where the toy is in animal-like or other figurative form, a sound appropriate thereto.

A significant feature of the invention is that the manner in which the body is deformed depends on how pressure is applied thereto by a player, so that the player can cause the body to assume whatever state of deformation that suits his fancy. This enhances the play value of the toy.

A salient advantage of the invention in its toy vehicle form is that the toy is almost indestructible; for not only is the auto body formed of resilient material but so are the wheels. And while the wheels are supported on a chassis of rigid plastic material and the body is mounted on this chassis, the body and wheels act to protectively shield the chassis. Thus, however hard the young player may try, he will not succeed in wrecking this toy.

Also an object of this invention is to provide an actuating element in the form of a fifth wheel on the rear of the vehicle which simulates a spare tire and also functions as an auxiliary bumper.

Briefly stated, these objects are attained in a sound-producing toy having a hollow body formed of resilient material, whereby when the body is depressed and deformed by a player, this action produces a honking sound. The body envelops an air-filled cavity at one end of which is an air-intake valve whose actuating element is outside the body so that when the element is actuated by the player, air is admitted into the cavity.

Also disposed in the cavity is a sound producer having an air outlet normally closed by a membrane which is partially secured to the outlet so that when the body is depressed by the player, the resultant increase in internal air pressure above ambient is exerted against the membrane and causes deflection thereof to permit air to escape from the outlet. The escaping air causes the membrane to vibrate to produce a honking sound. The air expelled through the outlet creates a partial vacuum in the internal cavity which acts to maintain the body in its deformed state. But when the player operates the actuating element of the air-intake valve, air is admitted into the cavity and the body resumes its normal state.

BRIEF DESCRIPTION OF DRAWINGS

For a better understanding of the invention as well as other objects and further features thereof, reference is made to the following detailed description to be read in conjunction with the accompanying drawings, wherein:

FIG. 1 is a perspective view of a sound-producing toy vehicle in accordance with the invention;

FIG. 3 shows the vehicle in its deformed state;

FIG. 6 is a bottom view of the sound producer; and

FIG. 7 is a section taken through the sound producer.

DESCRIPTION OF INVENTION

Figure 4:
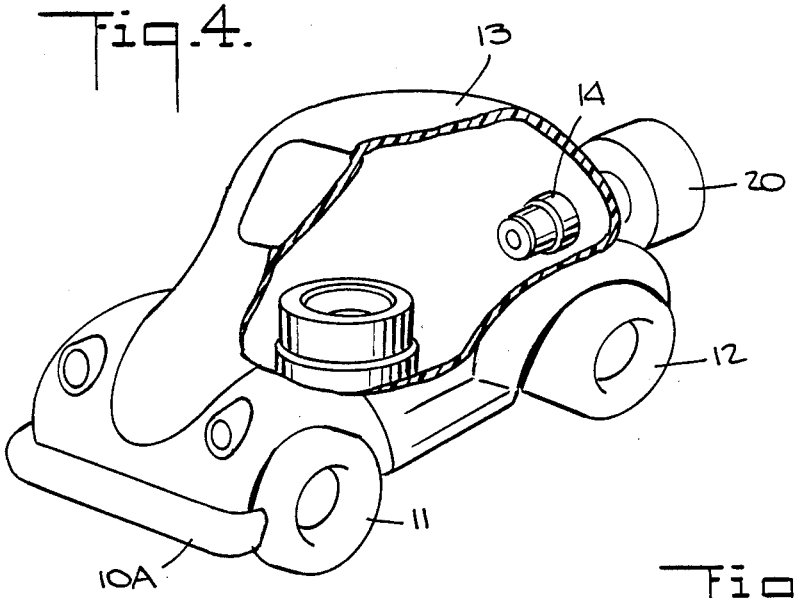
FIG. 4 is a cut-away view of the body which exposes the sound producer and the air-intake valve.

Referring now to FIG. 1, a vehicle in accordance with the invention includes a chassis 10 formed of rigid, high-strength, synthetic plastic material such as polyvinyl chloride or polycarbonate. Secured to the front end of chassis 10 is a bumper 10A and to the rear end thereof, a bumper 10B. Supported on chassis 10 are a front wheel set 11 and a rear wheel set 12.

Mounted on chassis 10 is a hollow body 13 molded of resilient, synthetic plastic material having rubber-like properties, so that when the material is flexed and then released, it will resume its normal form. The configuration of body 13 simulates that of a conventional automobile or other vehicle, and includes a front hood section, a windshield, side and rear windows, a trunk, etc. The body configuration illustrated in the drawing is by way of example only, for it may take other forms.

Hollow body 13 envelops an air-filled internal cavity into which air can be admitted only through an air-intake valve 14, and from which air can be expelled only through a sound producer 15. Sound producer 15 serves a dual function; for it not only acts to permit the escape of air, but also as a sound generator.

Figure 5:
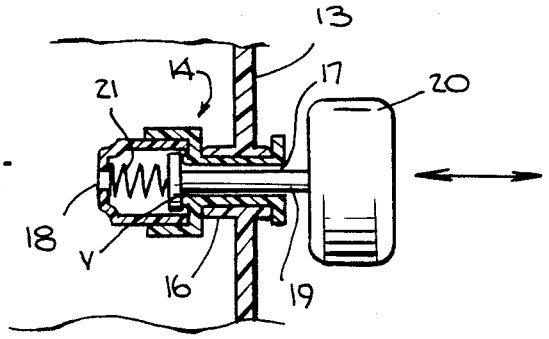
FIG. 5 is a section taken through the air-intake valve.

Air intake valve 14, which is disposed within the internal cavity of body 13 at the rear thereof, includes, as shown separately in FIG. 5, a cylindrical casing 16 having an inlet port 17 at one end which is exposed to the atmosphere, and an outlet port 18 at the other end which lies within the internal cavity of body 13.

Within casing 16 adjacent inlet port 17 is a valve member V mounted on a piston rod 19 which projects through the inlet port and terminates in an actuating element 20. This element takes the form of a fifth wheel which is disposed behind rear bumper 10B and acts not only to simulate a spare tire, but also as an auxiliary bumper should the rear of the vehicle be pushed against a wall or other barrier.

Interposed between valve member V and output port 18 within casing 16 is a compression spring 21 which urges the valve member against the inlet port 17 to block this port and thereby close the valve. But when actuating element 20 is pressed in by the player, valve member V is axially displaced from inlet port 17 and air is then admitted therein which passes through outlet port 18 into the internal cavity of body 13.

Figure 2:
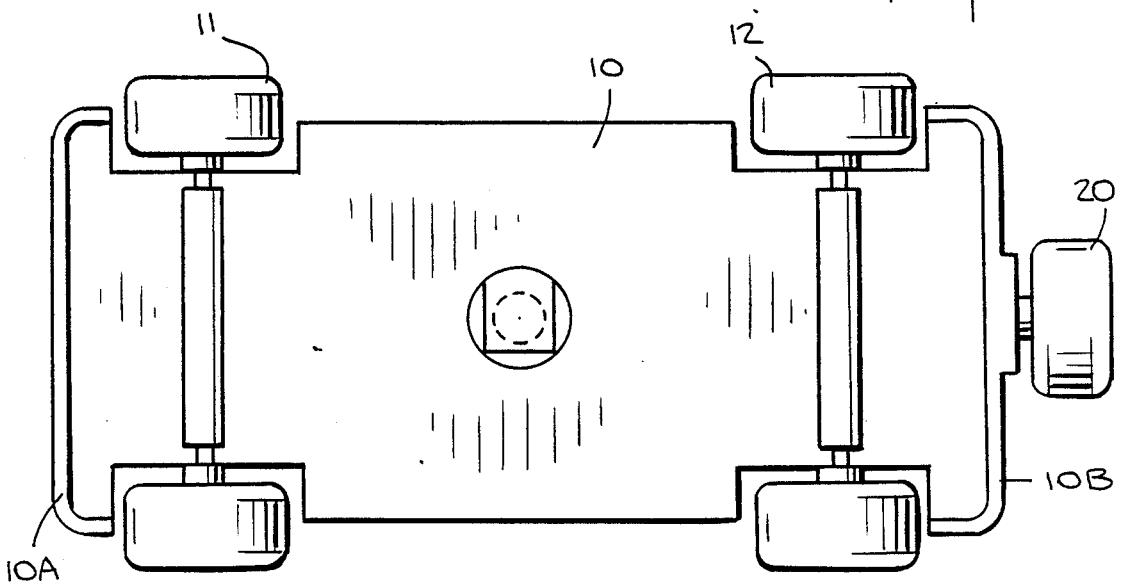
FIG. 2 is a plan view of the underside of the vehicle.

As shown in FIGS. 6 and 7, sound producer 15 includes a cylindrical cup 22 on whose bottom is a collar-shaped air outlet 23 which is coaxial with the wall of the cup. Cup 23 is secured to a circular base 24 having a generally rectangular port 25 which, as shown in FIG. 2, lies within a circular opening 26 in chassis 10.

Sandwiched between the bottom of cup 22 and base 24 is a thin, generally rectangular membrane M or diaphragm of flexible plastic material which normally covers outlet 23 so that at ambient air pressure within the internal cavity of body 13, outlet 23 is then closed. The long sides of membrane M and one end thereof are sealed to the bottom of cup 22, but the other end Ma is free and therefore is deflectable to permit the escape of air from outlet 23.

When, therefore, the hollow body 13 is depressed and deformed by the player as shown in FIG. 3, the resultant increase in internal air pressure above ambient within the cavity of the body exerts a pressure on membrane M to deflect the free end Ma thereof to permit the escape of air from the cavity.

When the body is depressed, the resultant rush of expelled air through outlet 23 excites the membrane into vibration and its natural resonance frequency, which is such as to generate a honking sound similar to that produced by an automobile horn.

When, therefore, body 13 is depressed and deformed as shown in FIG. 3, and air is expelled from the internal cavity to produce a honking sound, the body remains in its deformed state. The reason for this is that the partial vacuum created when air is expelled from the cavity acts to maintain the body.

However, the player, if he wishes to cause the body to resume its normal state, can then press in the fifth wheel actuating element 20 to admit air into the internal cavity, thereby permitting the deformed body to return to its normal state. Or instead of pressing in actuating element 20, the player can run the vehicle so that its rear end strikes a wall or other barrier, and in doing so, presses in the fifth wheel actuating element 20 to operate air-intake valve 16. Alternatively, the actuating element may take the form of a depressible gas tank cap of the vehicle or some other element thereon.

All wheels, including the fifth wheel 20, are formed of the same or similar resilient material as the hollow body 13; hence they are effectively unbreakable and serve to cushion the rigid chassis 10. As a consequence, the toy vehicle is virtually indestructible.

The toy therefore has a range of play possibilities, for the player can so deform the hollow body that it will assume any desired deformed configuration. And in doing so, the player produces a honking sound. The child, whenever he wishes to do so, operate the fifth wheel actuating element to cause the deformed body to resume its normal undeformed state. And the child can, of course, hand propel the vehicle to run in any direction on a playing surface.

As pointed out previously, the invention is not limited toy vehicles and can be applied to a hollow body configured to form an animal or other shaped play object which produces a sound appropriate to an object when deformed by the player. Thus in the case of a cat-like object, the sound would then be a meow-like sound.

While there has been shown and described a preferred embodiment of a sound-producing toy vehicle having deformable body in accordance with the invention, it will be appreciated that many changes and modifications may be made therein without, however, departing from the essential spirit thereof.

We claim:

1. A sound producing toy comprising:

(a) A contoured hollow body is that of a hand propelled toy vehicle having a predetermined normal shape further including a chassis on which the body is mounted and a set of front wheels and a set of rear wheels, the body being formed of resilient material which envelops an internal cavity;

(b) A normally closed air intake valve disposed in the cavity and said valve having an actuating element extending outside the body which when manually actuated admits atmospheric air into the cavity;

(c) An air outlet disposed in the cavity covered by a membrane said membrane having one end joined adjacent the outlet and having a deflectable section that is free of the outlet to form a vibratory element having a natural frequency in the sonic range, whereby when the body is manually distorted by a player, the resultant increase in internal pressure in the cavity is exerted on the free section to deflect it to permit the escape of air from the cavity, the rush of escaping air exciting said vibratory element into vibration to produce a sound that depends on said natural frequency, the escaped air from the cavity producing a negative pressure therein which acts to maintain the body in its distorted shape until the actuating element is actuated by the player to admit air into the cavity to cause the body to resume its normal shape.

2. A toy as set forth in claim 1, wherein said vibrating element has a natural frequency producing a honking sound.

3. A toy as set forth in claim 2, wherein said air-intake valve is provided with a cylindrical casing having at one end an air inlet port exposed to the atmosphere and at the opposite end an air outlet port communicating with the cavity, and a valve member within the casing mounted on a rod extending through the air inlet and urged by a spring against the inlet port to close the valve which is opened only when the rod is axially displaced.

4. A toy as set forth in claim 3, wherein said rod is coupled to a fifth wheel acting as the actuating element.

5. A toy as set forth in claim 4, wherein said valve is disposed at the rear of the body and the fifth wheel is disposed at the rear of the vehicle.

6. A toy as set forth in claim 5, wherein the fifth wheel and wheels in the front and rear sets are formed of the same resilient material as the body.

* * * * *